US007976079B2

(12) United States Patent
Hirtsiefer

(10) Patent No.: US 7,976,079 B2
(45) Date of Patent: Jul. 12, 2011

(54) RETAINING ELEMENT

(75) Inventor: Artur Hirtsiefer, Neunkirchen-Seelschied (DE)

(73) Assignee: Toplifter Beteiligungs-und Vertriebs GmbH & Co. KG (DE)

( * ) Notice: Subject to any disclaimer, the term of this patent is extended or adjusted under 35 U.S.C. 154(b) by 885 days.

(21) Appl. No.: 11/918,833

(22) PCT Filed: Mar. 22, 2006

(86) PCT No.: PCT/EP2006/002626

§ 371 (c)(1),
(2), (4) Date: Oct. 18, 2007

(87) PCT Pub. No.: WO2006/111236

PCT Pub. Date: Oct. 26, 2006

(65) Prior Publication Data

US 2009/0072551 A1 Mar. 19, 2009

(30) Foreign Application Priority Data

Apr. 20, 2005 (DE) ..... 10 2005 018 552

(51) Int. Cl.
*E05C 17/04* (2006.01)
*E05C 17/00* (2006.01)

(52) U.S. Cl. ..... 292/262; 16/286; 16/289; 312/326

(58) Field of Classification Search ..... 292/262; 16/286, 289; 312/319.8, 323, 325–328
See application file for complete search history.

(56) References Cited

U.S. PATENT DOCUMENTS

| | | | | |
|---|---|---|---|---|
| 1,581,172 | A * | 4/1926 | Butler | 292/263 |
| 2,779,069 | A * | 1/1957 | Ziesmer | 49/248 |
| 3,503,380 | A * | 3/1970 | Vasaturo | 126/191 |
| 3,712,287 | A * | 1/1973 | Summers, Jr. | 126/191 |
| 4,843,680 | A * | 7/1989 | Cress et al. | 16/289 |
| 5,271,652 | A * | 12/1993 | Watanabe et al. | 296/36 |
| 6,877,830 | B2 * | 4/2005 | Salice | 312/327 |
| 7,178,202 | B2 * | 2/2007 | Hirtsiefer et al. | 16/366 |
| 7,707,687 | B2 * | 5/2010 | Giovannetti | 16/289 |
| 2001/0020811 | A1 | 9/2001 | Kawanabe | |
| 2001/0039762 | A1 | 11/2001 | Giovannetti | |
| 2004/0239213 | A1 | 12/2004 | Hirtsiefer | |

FOREIGN PATENT DOCUMENTS

| | | |
|---|---|---|
| DE | 25 16 635 B1 | 4/1976 |
| DE | 26 33 787 A1 | 2/1978 |
| EP | 1 154 109 A | 11/2001 |

* cited by examiner

*Primary Examiner* — Carlos Lugo
(74) *Attorney, Agent, or Firm* — Harness, Dickey & Pierce, P.L.C.

(57) ABSTRACT

A retaining element for the lid of a cabinet has a linkage in the form of an eccentric sliding crank drive with an arm (1) as a slider link of the sliding crank drive. The arms (1) can be fixed to a cabinet housing (27) and pivotably connected to the lid and is pivotable around a first arm axis (5) of a first joint (6). A lever (2) can be fixed to the cabinet housing (27) and is pivotable around a first lever axis (7) of a second joint (8). A slider element (3) is guided at the arm (1) and is displaceable along a slider axis (12). The lever (2) is connected to the slider element (3) and is pivotable around a second lever axis (9). A force element (14) force-loads the arm (1) and slider element (3).

17 Claims, 7 Drawing Sheets

1
2
4
5
17
18
21
25
26
29
32
39
40
41
42

RETAINING ELEMENT

CROSS-REFERENCE TO RELATED APPLICATIONS

This application is a National Stage of International Application No. PCT/JP2006/002626, filed Mar. 22, 2006, which claims priority to German Patent Application No. 10 2005 018 552.5, filed Apr. 20, 2005. The disclosures of the above applications are incorporated herein by reference.

FIELD

The disclosure relates to a retaining element for a lid of a cabinet. The retaining element has an arm connected to a cabinet housing and pivotably connected to the lid. The arm is pivotable around a first arm axis of a first joint between an open position and a closed position. A lever is fixed to the cabinet housing so as to be pivotable around a first lever axis of a second joint. A slider element is guided at the arm so as to be displaceable along a slider axis. The lever is connected to the slider element so as to be pivotable around a second lever axis. The lever has a force element that is supported against the arm and against the slider element and force-loads the same.

BACKGROUND

A retaining element is known from DE 25 16 635 B1. This retaining element provides the arm in the form of a tube. The tube accommodates a force element in the form of a helical spring that is connected to the lever on the one hand and to the tube on the other hand. The helical spring is subjected to tensile loads and holds the arm in the closed position. When the lid is opened, the arm crosses a dead-centre position. From this position, the helical spring urges the arm into the open position so that the arm is automatically moved into the open position and is held in same. The first lever axis is arranged so that it and the first arm axis are positioned on the slider axis, with the helical spring being tensioned to its maximum. The lever enters the tube through a cut and is curved to be arch-shaped. The lever has a recess that embraces a bearing journal of the first joint. This occurs when the arm is in the position with the helical spring pretensioned to its maximum.

SUMMARY

It is an object of the present disclosure to provide a retaining element that has a simple design and can easily be set to suit different lids.

Accordingly, a retaining element is provided for the lid of a cabinet. The retaining element has as a linkage in the form of an eccentric sliding crank drive. An arm acts as a slider of the sliding crank drive. The arm is fixed to a cabinet housing and a cabinet lid. The arm is pivotable around a first arm axis of a first joint between an open position and a closed position. A lever acts as a crank of the sliding crank drive. The lever is fixed to the cabinet housing and is pivotable around a first lever axis of a second joint. A slider element acts as a slider of the sliding crank drive. The slider element is guided at the arm and is displaceable along a slider axis. The lever is connected to the slider element and is pivotable around a second lever axis. The slider axis intersects the first arm axis at a distance. A force element is supported against the arm and against the slider element and force-loads the same.

The retaining element is provided as a four joint drive in the form of an eccentric sliding crank drive. Thus, the slider axis intersects the first arm axis at a distance. A collision of the lever with the first joint is prevented when the arm is pivoted. Thus, the holding arm has a simpler design, for example, the lever can be straight.

A further advantage of the straight lever is that it can pass on, particularly easily, the to be accommodated forces. More particularly, when the lever is pressure-loaded, a straight lever is advantageous because the lever does not have to be reinforced against being bent.

In an advantageous embodiment, an adjusting mechanism enables adjustment of the position of at least one of the joints. Therefore, by adjusting the force of the force element, the retaining element can be set to suit different lids. This is possible by setting the pretension of the spring. Thus, the positions of the joint can be adjusted relative to one another. Additionally, the force of the force element can be set. The joints are mounted at the cabinet housing. Thus, easy accessibility and a simple design are ensured. The adjusting mechanism includes a support element that carries the first and the second joint. The adjusting mechanism can at least be indirectly fixed at the cabinet housing. The support element includes a base element and a slide. The base element has a guide along which the slide is displaceably guided. One of the joints is provided at the base element. The other one is provided at the slide. This ensures a simple and robust design of the adjusting mechanism.

The first joint is provided at the base element. The second joint is at the slide. Accordingly, it is not the joint of the greater arm which has to be displaced, but the joint of the smaller lever.

A fixing plate is provided to ensure that both joints are adjusted to compensate for production tolerances of the cabinets. The support element is displaceably fixed to the fixing plate and, in turn, can be fixed at the cabinet housing.

The support element can be fixed at an assembly plate. The assembly plate is displaceably arranged along a guide of the fixing plate. Thus, it is possible to provide different assembly plates and fixing plates for different cabinets without modifying the support element.

The slider element is displaceably guided at the arm along a slider axis. The arm includes a tube which displaceably guides the slider element. The retaining element is designed so that the arm, in the open position, is retained in position by the force element.

The force element is preferably a pneumatic spring. The force element approximately applies a constant force, independently of the compression of the spring. Thus, it is possible to provide a retaining element that is designed so that the lid, at least starting from a dead-centre position, is retained in any position towards the open position. Since the force of the pneumatic spring and the linkage are such that the lid is retained in any position, there is no need for any braking means. As a result, the lid is easy to pivot. A dead center has to be provided in those cases where, as from the latter, a traction torque has to be generated towards the closed position.

The retaining element can be intended for a lid that is pivotably fixed at the cabinet housing of the cabinet. The arm is pivotable around a second arm axis of a third joint. The arm is fixed so as to be displaceable at the lid. In such an embodiment, the lid is pivoted around a pivot axis relative to the cabinet housing.

The retaining element can also be intended for a lid that is not directly fixed at the cabinet housing of the cabinet. Thus, the arm is fixed at the lid and is pivotable around a second arm axis of a third joint. The retaining element includes a control arm that is fixed at the cabinet body and is pivotable around a first control arm axis of a fourth joint. The control arm is fixed at the lid and is pivotable around a second control arm axis of a fifth joint. In this embodiment, the lid is either displaced in parallel or pivoted over the upper base of the cabinet housing.

The retaining element can include a fixing element fixed to the arm and is pivotable around a second arm axis. The control arm is pivotable around the second control arm axis. The fixing element is fixable at the lid. Thus, an assembly is provided that is easy to mount.

In a further embodiment, the retaining element is intended for a lid in the form of a foldable lid with a first lid element and a second lid element. The first lid element is pivotably fixed at the cabinet housing. The second lid element is fixed and is pivotable with the first lid element. The arm is fixed at the second lid element of the lid and is pivotable around the second arm axis of a third joint. In this embodiment, the lid, when being opened, is folded upwardly.

DRAWINGS

A preferred embodiment will be explained in greater detail with reference to the drawings wherein.

DETAILED DESCRIPTION

Figure 1:
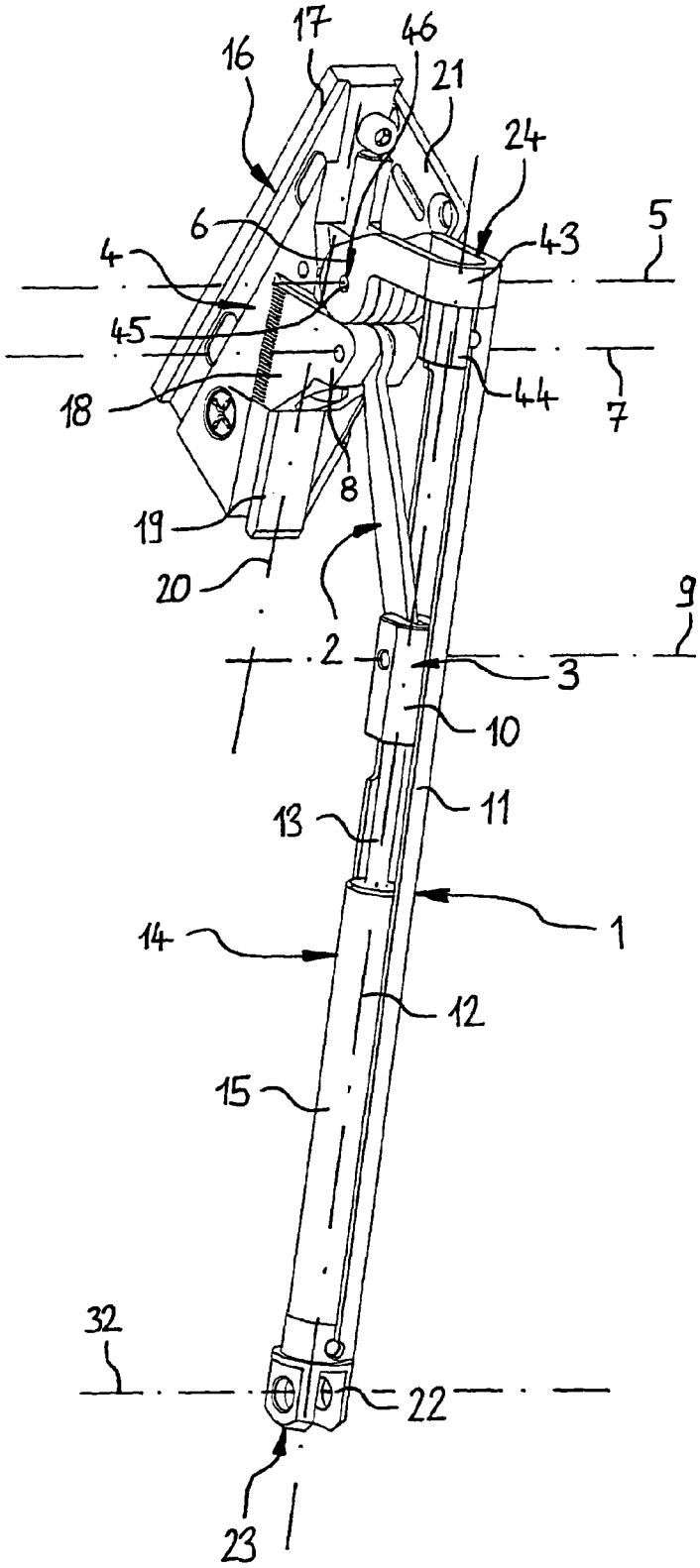
FIG. 1 is a perspective view of a retaining element.
Figure 2:
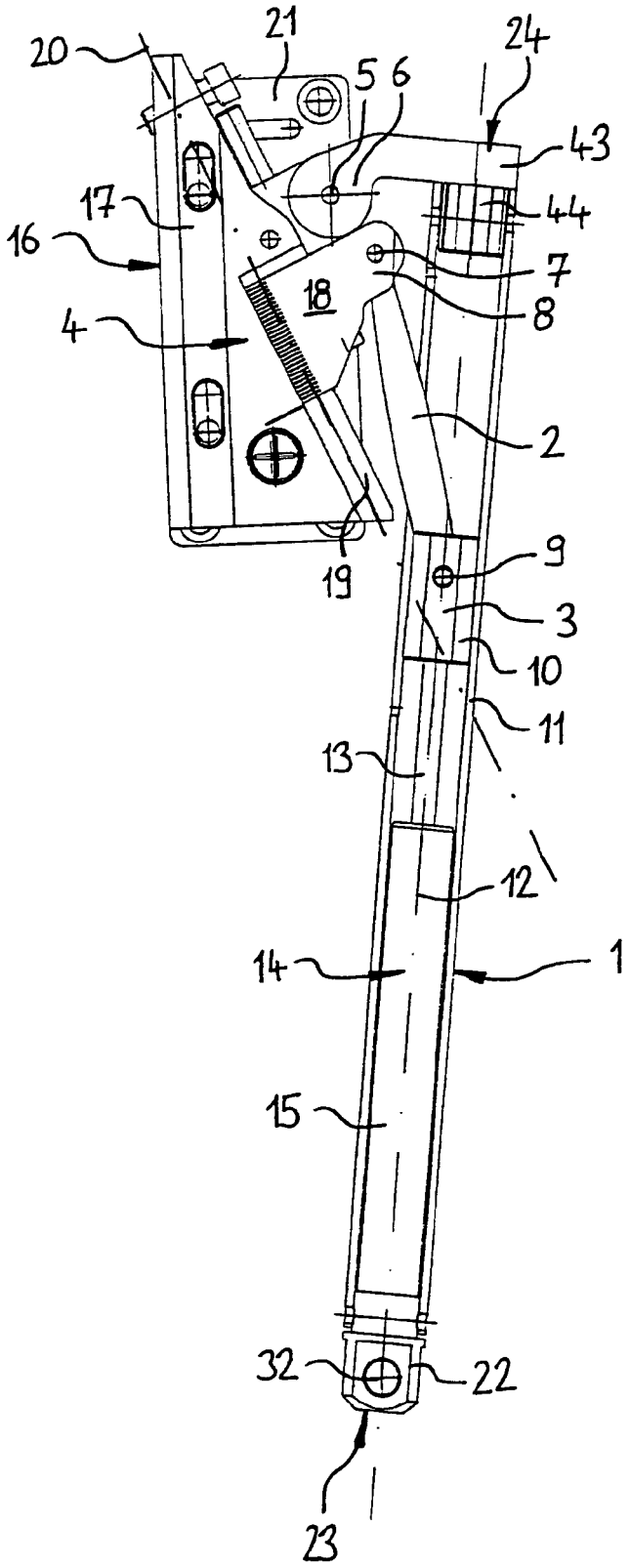
FIG. 2 is a longitudinal section view through the retaining element according to FIG. 1, in a closed position.
Figure 3:
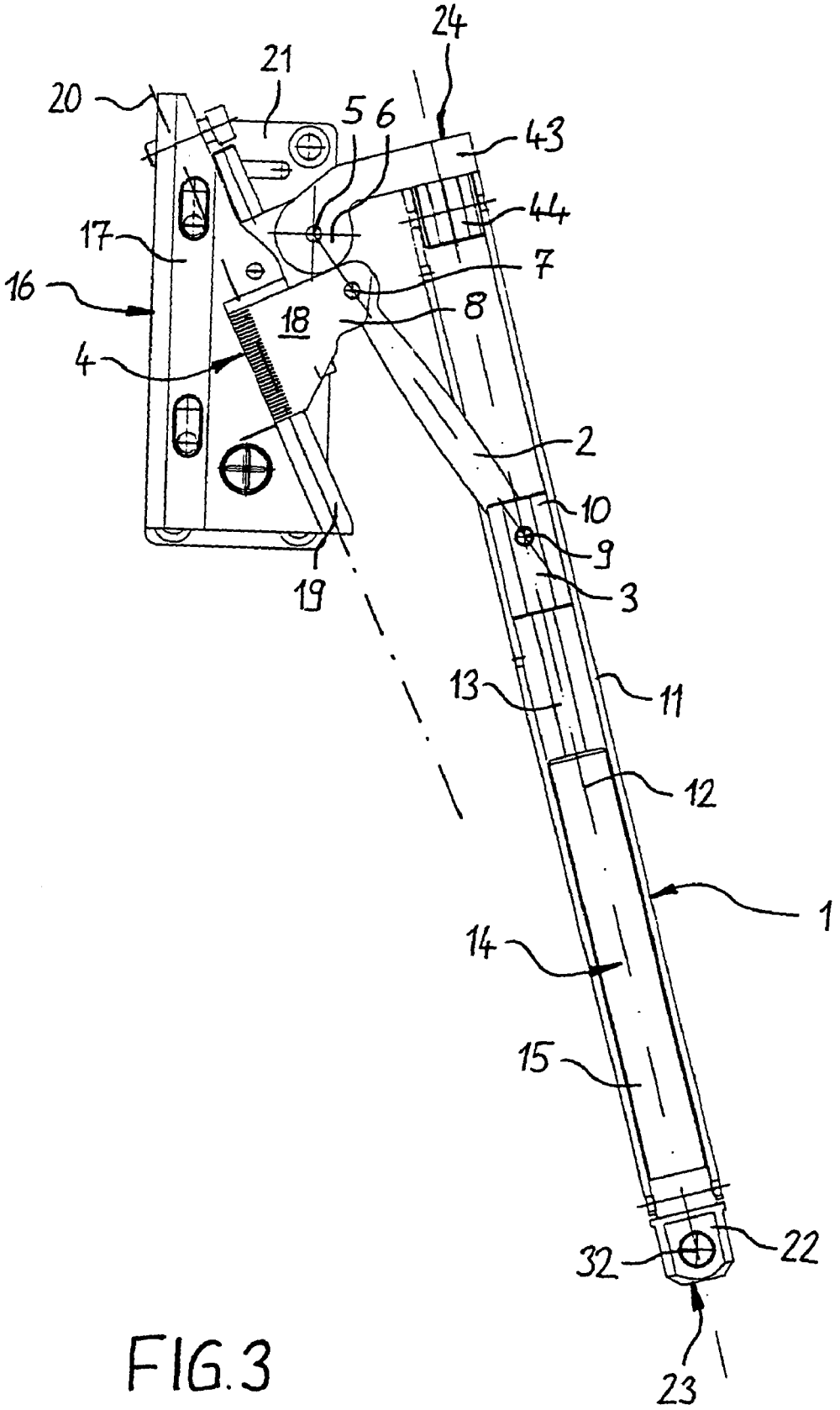
FIG. 3 is a longitudinal section view through the retaining element according to FIG. 1, in an intermediate position.
Figure 4:
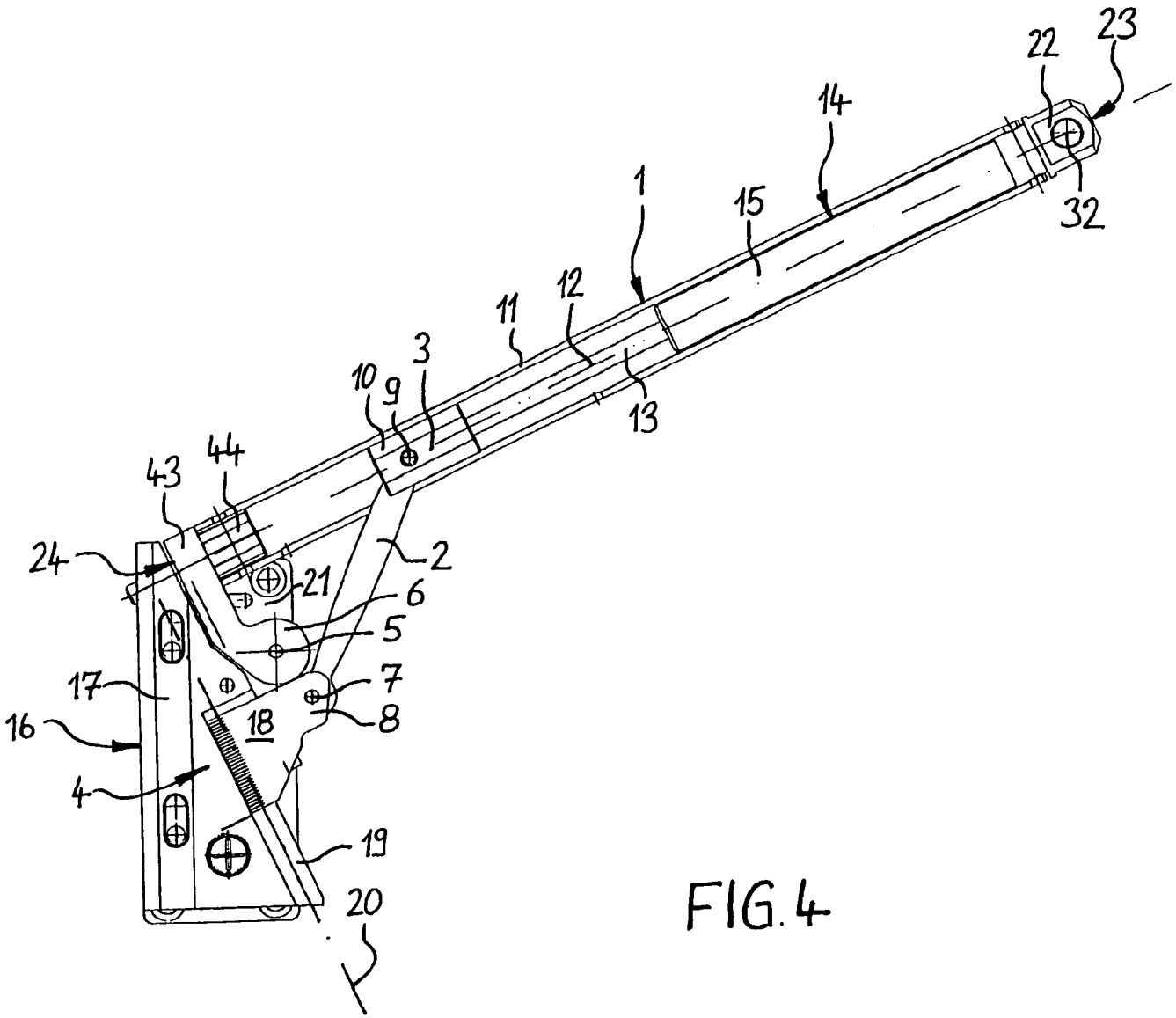
FIG. 4 is a longitudinal section view through the retaining element according to FIG. 1, in the open position.

FIGS. 1 to 4 show a retaining element in different illustrations and will be described jointly below.

The retaining element comprises an arm 1, a lever 2, a slider element 3 and a force element 4. The arm 1 is fixable at a cabinet housing and is pivotable around a first arm axis 5 of a first joint 6 between the closed position shown in FIG. 2 and the open position shown in FIG. 4. Furthermore, the arm 1 can be connected to a lid of the cabinet and is pivotable around a second arm axis 32.

The lever 2 can be fixed to the cabinet housing and is pivotable around a first lever axis 7 of a second joint 8. Furthermore, the lever 2 is connected to the slider element 3 and is pivotable around a second lever axis 9.

The slider element 3 includes a partially cylindrical outer face which forms a sliding face 10. The face 10 of the slider element 2 is displaceably guided in a tube 11 of the first arm along a slider axis 12. The slider axis 12 is arranged so that it intersects the first arm axis 5 at a distance. For this purpose, the arm 1 includes a joint part 43 which is fixed at an end 24 of the tube 11. The part 43 projects transversely relative to the slider axis 12. The joint part 43 has a fixing projection 44 that projects in the direction of the slider axis 12. Also, the projection 44 is inserted into the tube 11. At the opposite end of the joint part 43, a joint bore 45 is provided to receive a joint journal 46 of the first joint 6.

The arm 1, the lever 2, the slider element 3, the first joint 6 and the second joint 8 form a linkage in the form of an eccentric (offset) sliding crank drive. The arm 1 forms the slider link. The lever 2 forms the crank. The slider element 3 forms the sliding block (slider) of the sliding crank drive.

In order to generate a force that acts against the weight force of the lid, a pneumatic spring 14 is provided and is arranged inside the tube 11. A piston rod 13 is axially supported relative to the slider axis 12 against the slider element 3. The piston 15 of the pneumatic spring 14 is fixed in the tube 11 at the free end 23 of the tube 11 which faces away from the first joint 6. The slider element 3 is force-loaded towards the end 24 of the tube 11 that approaches the first joint 6. In the mounted condition, the first lever axis 7 is arranged vertically underneath the first arm axis 5. A torque is generated towards the open position of the retaining element, as illustrated in an intermediate position according to FIG. 3. This corresponds to the dead-center position of the retaining element. Here, the first arm axis 5, the first lever axis 7 and the second lever axis 9 are positioned on a common plane.

As compared to helical springs, pneumatic springs have a very flat characteristic spring curve (load deflexion curve). Thus, the force generated by the pneumatic spring changes only very lightly when the spring travel and stroke travel change. More particularly, when using a pneumatic spring, the torque is adjusted to the lid weight towards the open position so that the lid is retained in any position between the intermediate position and the open position.

In principle, it is also conceivable for the first lever axis 7 to be arranged vertically above the first arm axis 5. In such a case, however, the pneumatic spring 14 has to be supported on the end 24 of the arm that approaches the first joint 6. The slider element 3, in order to load the slider element 3, is positioned towards the free end 23 of the tube 11. In such a case, however, the lever 2 is clearly longer in order to provide an adequate space for the pneumatic spring 14 between the slider element 3 and the end 24 of the tube.

An adjusting mechanism 4 is provided. The adjusting mechanism includes a support element 16. The support element 16 has a base element 17 and a slide 18. The base element 17 carries the first joint 6. The slide 18 carries the second joint 8. The slide 18 is adjustable relative to the support element 16 along a guide 19 along an adjustment axis 20. As a result, it is possible to vary the distance between the first joint 6 and the second joint 8 and, respectively, between the first arm axis 5 and the first lever axis 7 in order to adapt the retaining element to different lid weights. The adjustment axis 20 extends parallel to or approximately parallel to the slider axis 12 when the arm 1 is in the intermediate position (dead-center position).

The support element 16 is fixed to an assembly plate 21. The assembly plate 21, the base element 17 and the slide 18 form a unit. The assembly plate 21, in turn, can be adjustably attached to a fixing plate (not shown). The fixing plate can be attached directly to a side wall of a cabinet housing.

The arm 1 is provided with a fixing mechanism 22. The fixing mechanism 22 pivotably fixes the free end 23 of the arm 1 to a lid.

Figure 7:
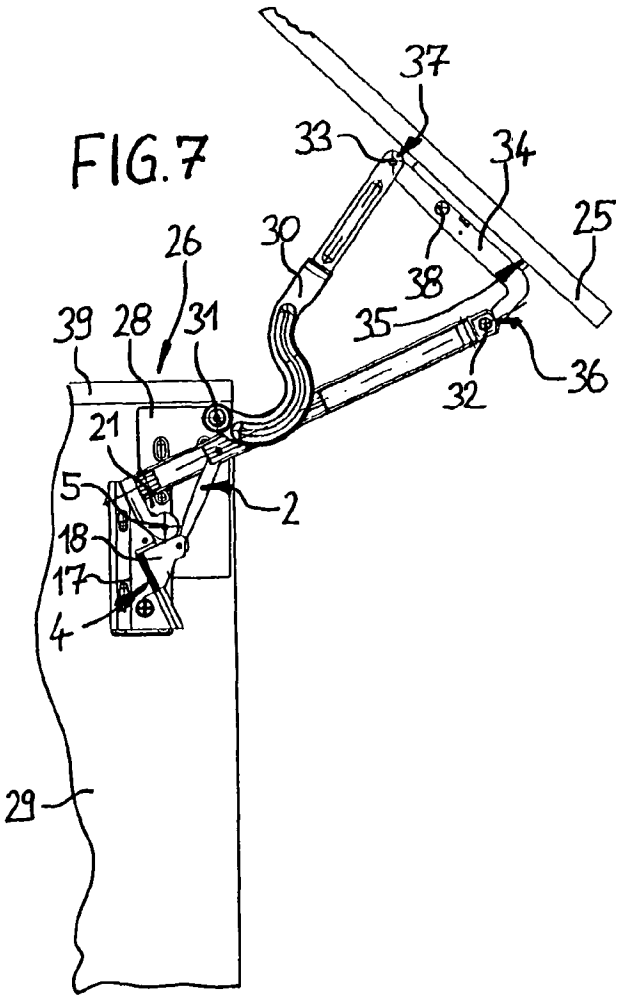
FIG. 7 is a longitudinal section view through the retaining element according to FIG. 1, in the open position in the first application.
Figure 6:
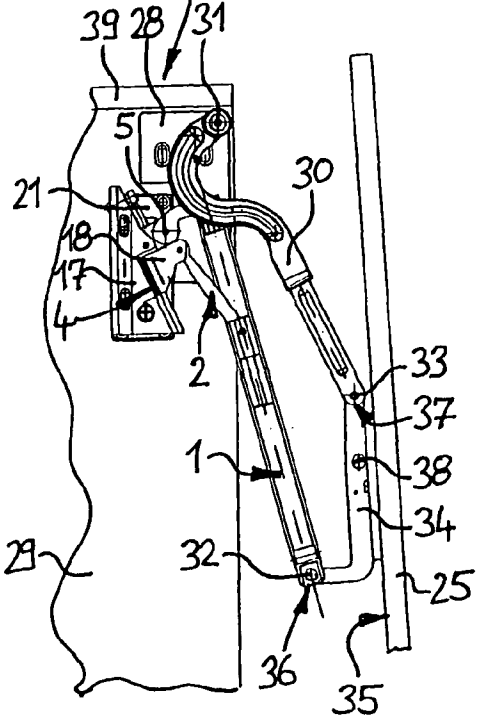
FIG. 6 is a longitudinal section view through the retaining element according to FIG. 1, in an intermediate position in the first application.
Figure 5:
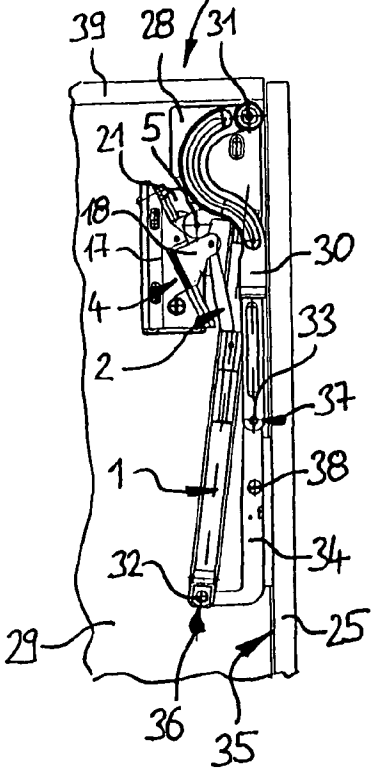
FIG. 5 is a longitudinal section view through the retaining element according to FIG. 1, in a closed position in a first application.

FIGS. 5 to 7 show the retaining element according to FIGS. 1 to 4 in an application wherein a lid 25 of a cabinet 26 is not directly pivotably attached to a cabinet housing 27 of the cabinet 26. The lid 25 is held entirely by the retaining element. FIG. 5 shows the retaining element in the closed position. FIG. 6 shows it in the intermediate position. FIG. 7 shows it in the open position.

The assembly plate 21 of the retaining element is fixed to a fixing plate 28 so that the assembly plate 21 can be vertically adjusted and then fixed. The fixing plate 28 is attached to a side wall 29 of the cabinet 26.

A control arm 30 is fixed to the fixing plate 28 and is pivotable around a first control arm axis 31. The free end of the arm 1 is fixed to the lid 25 by fixing mechanism 22, in the form of a bore, and is pivotable around a second arm axis 32. A fixing element 34, to which both the arm 1 and the control arm 30 are pivotably fixed, is used for this purpose. The fixing element 34 is fixed to an inner side 35 of the lid. The fixing element 34 has a first bore 36 to which the arm is pivotably fixed. A second bore 37 and a third bore 38 are provided and serve to pivotably connect the control arm 30. In FIGS. 5 to 7, the control arm 30 is pivotably fixed at the second bore 27. The distances between the arm axes 5, 32 and the control arm axes 31, 33 are adjusted to one another so that the lid, as shown in FIG. 7, swings beyond the upper base of the cabinet 26.

Figure 10:
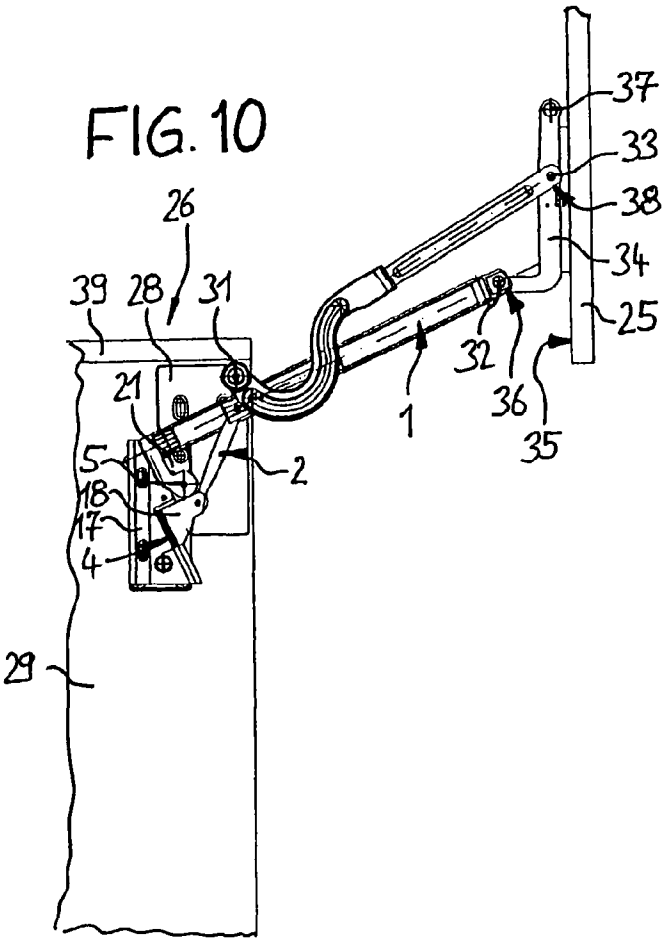
FIG. 10 is a longitudinal section view through the retaining element according to FIG. 1, in the open position in the second application.
Figure 9:
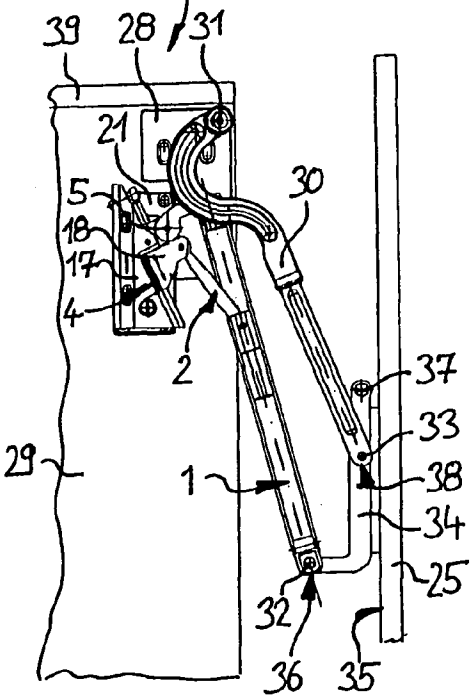
FIG. 9 is a longitudinal section view through the retaining element according to FIG. 1, in the intermediate position in the second application.
Figure 8:
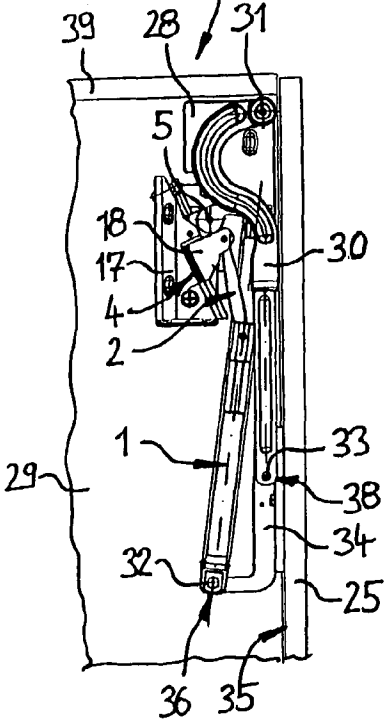
FIG. 8 is a longitudinal section view through the retaining element according to FIG. 1, in the closed position in a second application.

If the control arm 30 is pivotably connected to the fixing element 34 at the third bore 38 and thus to the lid 25, the distances between the axes 5, 31, 32, 33 are adjusted to one another so that the lid, as illustrated in FIG. 10, is adjusted in parallel. FIG. 8 shows the retaining element in the closed position, FIG. 9 in the intermediate position and FIG. 10 in the open position.

Figures 11, 12, 13:
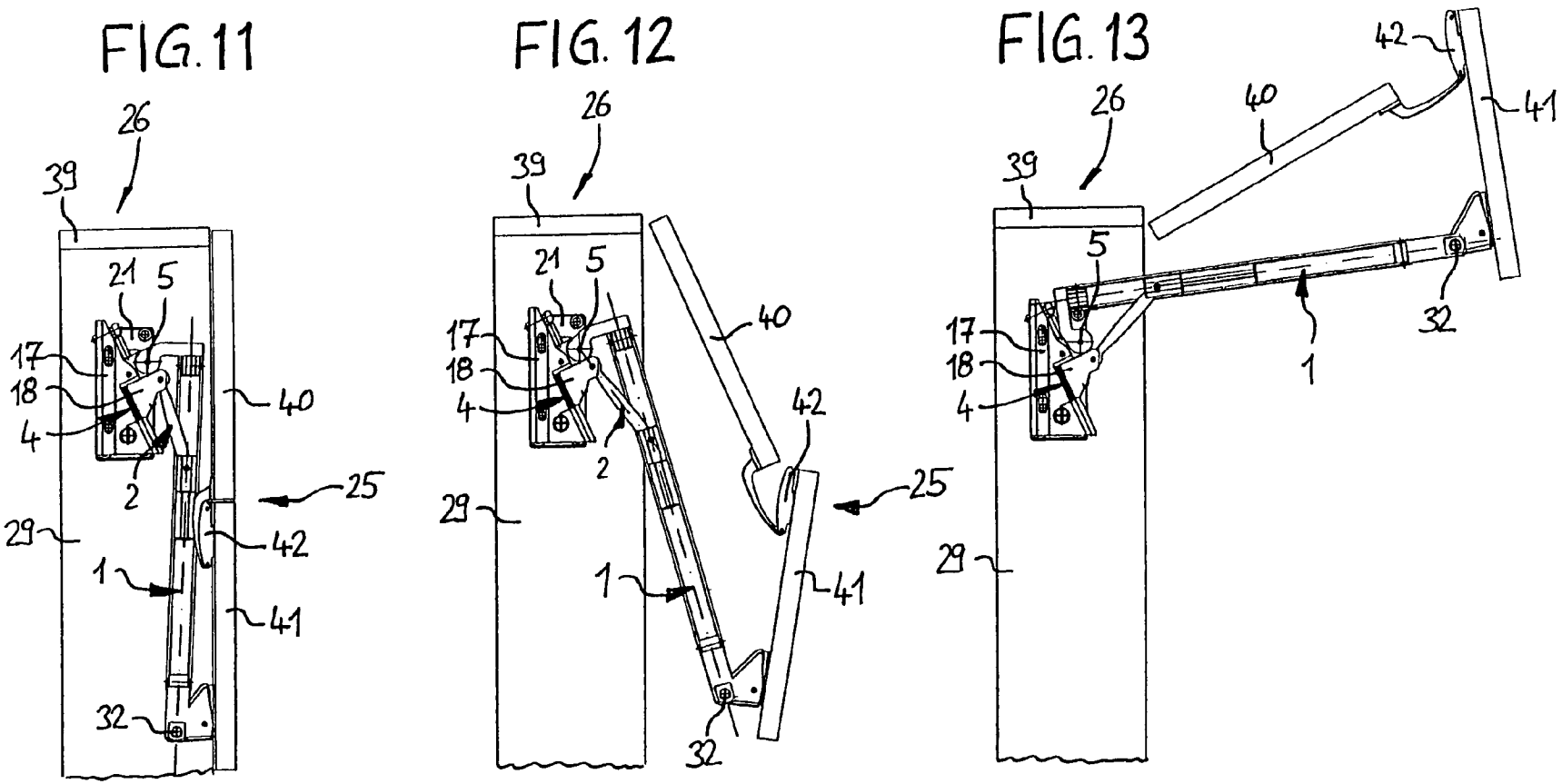
FIG. 11 is a longitudinal section view through the retaining element according to FIG. 1, in the closed position in a third application.
FIG. 12 is a longitudinal section view through the retaining element according to FIG. 1, in the intermediate position in the third application.
FIG. 13 is a longitudinal section view of the retaining element according to FIG. 1, in the open position in the third application.

FIGS. 11 to 13 show the retaining element according to FIGS. 1 to 4 in a further application. The lid 25 is in the form of a foldable lid with a first lid element 40 and a second lid element 41. The first lid element 40 is fixed to be directly pivotable to a cabinet housing 27 of the cabinet 26. The second lid element 41 is connected to the first lid element 40 and is pivotable via hinges 42. FIG. 11 shows the retaining element in the closed position, FIG. 12 in the intermediate position and FIG. 13 in the open position.

The retaining element does not include a fixing plate, but is directly fixed to the assembly plate 21 at the side wall 29 of the cabinet 26. However, to be able to set the retaining element vertically, it is also possible to provide a fixing plate.

Furthermore, in contrast to the previous examples of applications, there is no need for a control arm. The arm 1 of the retaining element is directly pivotably fixed to the lower end of the second lid element 41.

The description of the invention is merely exemplary in nature and, thus, variations that do not depart from the gist of the invention are intended to be within the scope of the invention. Such variations are not to be regarded as a departure from the spirit and scope of the invention.

What is claimed:

1. A retaining element for a lid of a cabinet, the retaining element is a linkage in the form of an eccentric sliding crank drive, comprising:

a support structure adapted to be mounted to said cabinet, and having a first joint and a second joint;

an arm acts as a slider link of the sliding crank drive, said arm having a first end and a second end, said first end attached to said lid and said second end being connected to the first joint to pivot about a first arm axis between an open position and a closed position;

a lever acts as a crank of the sliding crank drive, said lever having a first end and a second end, said second end being connected to the second joint to pivot about a first lever axis of the second joint, the first arm axis and first lever axis are in a fixed position with respect to one another;

a slider element acts as a slider of the sliding crank drive, said slider element positioned within the arm to be guided and displaceable along a slider axis, said first end of said lever being connected to the slider element and is pivotable around a second lever axis, said slider axis intersects the first arm axis at a distance;

a force element is supported against the first end of said arm and against the slider element, said force element force-loads against said arm and slider element wherein the retaining element retains a lid between an open and closed position.

2. The retaining element according to claim 1, wherein said support structure further comprising a base including the first joint and a slide including the second joint, the base and slide acts as an adjusting mechanism for spacing the first arm axis with respect to the first lever axis for accommodating different lid weights.

3. The retaining element according to claim 2, wherein said support structure can be indirectly fixed to said cabinet.

4. The retaining element according to claim 3, wherein said base element comprises a guide along which the slide is displaceable, and one of the joints is provided on the base element and the other joint is provided on the slide.

5. The retaining element according to claim 4, wherein the first joint is provided on the base element and the second joint on the slide.

6. The retaining element according to claim 3, further comprising a fixing plate displaceably fixing the support element, said fixing plate fixed to the cabinet housing.

7. The retaining element according to claim 6, wherein the support element is fixed to an assembly plate which is displaceable along a guide of the fixing plate.

8. The retaining element according to claim 1, wherein the slider element is displaceably guided at the arm along a slider axis.

9. The retaining element according to claim 8, wherein the arm further comprises a tube in which the slider element is displaceably guided.

10. The retaining element according to claim 1, wherein, in the open position, the arm is held in this position by the force element.

11. The retaining element according to claim 1, wherein, in the closed position, the arm is held in this position by the force element.

12. The retaining element according to claim 1, wherein the force element is a pneumatic spring.

13. The retaining element according to claim 1, wherein the retaining element is intended for a lid which is pivotably fixed at the cabinet housing of the cabinet, and that the arm is fixed at the lid and is displaceable and pivotable around a second arm axis of a third joint.

14. The retaining element according to claim 1, wherein the retaining element is intended for a lid which is not directly fixed at the cabinet housing of the cabinet, the arm can be fixed to the lid and is pivotable around a second arm axis of a third joint, the retaining element comprises a control arm that is fixed to the cabinet body and is pivotable around a first control arm axis (31) of a fourth joint, and the control arm can be fixed to a lid and be pivotable around a second control arm axis of a fifth joint.

15. The retaining element according to claim 14, wherein the retaining element further comprises a fixing element fixed to the arm and is pivotable around the second arm axis, and the control arm is fixed and is pivotable around the second control arm axis, the fixing element can be fixed to the lid.

16. The retaining element according to claim 1, wherein the retaining element is intended for a lid in the form of a foldable lid with a first lid element and a second lid element, the first lid element is pivotably fixed at the cabinet housing and the second lid element is pivotably fixed to the first lid element; and the arm can be fixed to the second lid element of the lid and is pivotable around a second arm axis of a third joint.

17. A retaining element for a lid of a cabinet, the retaining element is a linkage in the form of an eccentric sliding crank drive, comprising:

a support structure adapted to be mounted to said cabinet, and comprising a base having a first joint and a slide having a second joint;

an arm acts as a slider link of the sliding crank drive, the arm having a first end and a second end, said first end attached to said lid and said second end being connected to the first joint lid to pivot about a first arm axis between an open position and a closed position;

a lever acts as a crank of the sliding crank drive, the lever having a first end and a second end, the second end being connected to the second joint to pivot about a first lever axis of the second joint, the first arm axis and first lever axis are in a fixed position with respect to one another;

a slider element acts as a slider of the sliding crank drive, the slider element postioned within the arm to be guided and displaceable along a slider axis, the first end of said lever being connected to the slider element and is pivotable around a second lever axis, the slider axis intersects the first arm axis at a distance; and a force element is supported against the first end of the arm and against the slider element, said force element force-loads against the arm and slider element wherein the retaining element retains a lid between an open and closed position.

* * * * *

UNITED STATES PATENT AND TRADEMARK OFFICE

CERTIFICATE OF CORRECTION

PATENT NO. : 7,976,079 B2
APPLICATION NO. : 11/918833
DATED : July 12, 2011
INVENTOR(S) : Artur Hirtsiefer It is certified that error appears in the above-identified patent and that said Letters Patent is hereby corrected as shown below:

Column 1

Line 7 "PCT/JP2006/002626" should be --PCT/EP2006/002626--

Signed and Sealed this
Fifteenth Day of November, 2011

David J. Kappos

David J. Kappos
*Director of the United States Patent and Trademark Office*